US006095259A

United States Patent [19]

Keyes

[11] Patent Number: 6,095,259

[45] Date of Patent: Aug. 1, 2000

[54] CORE SAMPLER APPARATUS WITH SPECIFIC ATTACHMENT MEANS

[76] Inventor: Robert C. Keyes, 3403 36th Ave. Northeast, Norman, Okla. 73071

[21] Appl. No.: 09/054,428

[22] Filed: Apr. 3, 1998

Related U.S. Application Data

[60] Provisional application No. 60/046,982, Apr. 4, 1997.

[51] Int. Cl.[7] ..... E21B 49/00

[52] U.S. Cl. ..... 175/20; 285/86; 403/378

[58] Field of Search ..... 285/86, 314, 315; 175/20, 320, 244, 232, 236, 239, 249, 234, 317; 73/864.44; 403/378, 379.2, 10, 315, 316, 110, 341, 374.3, 393, 396; 15/143.1, 144.1, 144.3, 144.4; 294/51, 57, 59

[56] References Cited

U.S. PATENT DOCUMENTS

| | | | |
|---|---|---|---|
| 3,515,230 | 6/1970 | Tomaine | 175/20 |
| 3,664,438 | 5/1972 | Winget et al. . | |
| 3,670,830 | 6/1972 | Van Der Wijden . | |
| 3,878,906 | 4/1975 | Guest | 175/405 |
| 3,933,209 | 1/1976 | Sweeney . | |
| 4,099,585 | 7/1978 | Emmerich | 175/320 |
| 4,142,594 | 3/1979 | Thompson et al. . | |
| 4,230,192 | 10/1980 | Pfannkuche . | |
| 4,452,322 | 6/1984 | Jürgens . | |
| 4,566,545 | 1/1986 | Story et al. . | |
| 4,664,204 | 5/1987 | Nenkov et al. . | |
| 4,702,327 | 10/1987 | Barrett . | |
| 4,875,531 | 10/1989 | Biehl et al. . | |
| 5,325,930 | 7/1994 | Harrison . | |
| 5,409,324 | 4/1995 | Johnson, Jr. | 403/355 |

*Primary Examiner*—Eileen Dunn Lillis
*Assistant Examiner*—Sunil Singh
*Attorney, Agent, or Firm*—Crowe & Dunlevy

[57] ABSTRACT

A core sampler apparatus for use at the end of a drill string of a drilling rig having a hollow barrel assembly for receiving a subterranean core sample, a shoe supported at a bottom end of the barrel assembly, and a connector member providing a pinned attachment of the barrel assembly to the drill string.

4 Claims, 5 Drawing Sheets

CORE SAMPLER APPARATUS WITH SPECIFIC ATTACHMENT MEANS

RELATED APPLICATION

This application claims priority to U.S. Provisional Application Ser. No. 60/046,982 entitled SPLIT BARREL CORE SAMPLER APPARATUS, filed Apr. 4, 1997, hereby incorporated by reference.

FIELD OF THE INVENTION

This invention relates to the field of continuous core sampling, and more particularly, but not by way of limitation, to a split barrel core sampler used in conjunction with a drill string of a drilling rig to obtain subterranean core samples.

BACKGROUND

A well known and practiced method of obtaining subterranean core samples is to use a split barrel core sampler in conjunction with a hollow stem drilling auger bit or in conjunction with a drive hammer. Subterranean core samples provide valuable information to those in the environmental and geotechnical industries. The core sampler is forced downward into the subterranean surface, causing the core sample to be forced upward into a passageway in the hollow barrel of the core sampler. After the core sample has been gathered, the core sampler is retrieved from the subterranean location and removed from the drilling string to retrieve the core sample. A core sampler with a characteristic split barrel facilitates the removal of the core sample after the core sampler has been removed from the drill string.

It is advantageous to develop methods and devices that minimize the amount of time and manpower necessary to retrieve a gathered core sample. This is because the drilling rig is shut down during this time, so drilling efficiency is directly impacted by the core sample retrieval. Thus, shortening the retrieval time results in higher drilling rig operational efficiency, meaning proportionally more time at the drill site is spent on productive activities like drilling or sample collecting, rather than on core sample retrieval.

There is a need in the industry to improve the conventional means of attaching drilling and sampling tools to a drilling rig drill string. The commonly used means of threadingly engaging these members is cumbersome, typically requiring at least two operators with large wrenches to break the threaded connector loose. Further, the nature of a threaded connection is inherently counter-productive to maximizing the efficiency of the retrieval process, because the rotary action of the drilling string tends to over-tighten the joints. Moreover, a threaded connection is subject to wear and tear with age, especially in the aggressive downhole environment at hand, and as such, connections become progressively more difficult and time consuming to make and break. Finally, threaded connections are subject to catastrophic failure when they become cross-threaded or stripped, and repair or recovery of a stripped or cross-threaded joint can easily result in many man-hours of rig downtime.

SUMMARY

The present invention provides a core sampler apparatus that is removable from a drill string, of a drilling rig with a threaded tool shaft, without breaking the threaded connection therebetween. The core sampler has a hollow barrel assembly forming a passageway into which a subterranean core sample is collected, a shoe member attached to the lower end of the barrel assembly forming an opening for the passageway, and a connector member attached to the upper end of the barrel assembly and to the drill string.

The barrel assembly furthermore has a tang portion at an upper end thereof which is receivingly engaged by the connector member. Preferably the barrel assembly, including the tang portion, is split into two substantially half portions along a longitudinal axis so that the half portions can be separated to facilitate retrieval of a core sample from the barrel assembly. The half portions are matingly engaged along the seam formed therebetween, the first half member having a longitudinal tab which interlockingly engages a longitudinal groove in the second half member to support the half portions in mating engagement.

The barrel assembly has a threaded lower end, formed by the mating engagement of the two half portions, which is threadingly engaged by the shoe member to retain the two half portions together and to form the passageway for the core sample. The upper end of the barrel assembly is retained by the receiving engagement of the tang portion, likewise formed by the mating engagement of the two half portions, into a bore of the connector member. The connector member has an aperture in alignment with an aperture in the tang portion and a pin placed in the aligned apertures connects the tang portion of the barrel assembly to the connector member. The opposing end of the connector member threadingly engages the drill string of the drilling rig.

In this manner, one skilled in the art will recognize that the core barrel assembly can be removed for retrieval of a core sample without breaking the threaded connection with the drill string. By removing the pin, the barrel assembly is removable by removing the tang portion from the bore of the connector member.

The core sampler of the present invention may be used in conjunction with any method used in collecting subterranean core samples, such as a drive hammer or a hollow stem auger bit. In use with a hollow stem auger bit, however, where rotational motion is transferred from the connector member to the barrel assembly it is preferable to provide a characteristic shape to the tang portion and the connector bore to rigidly engage the two. Preferably for this application a hexagonal tang portion and connector bore are employed.

The pin used to engage the connector member and the tang portion can be any conventional locking type pin, such as an offset loop type pin, or it may be a press fit type pin or a mechanical fastener such as a nut and bolt. To speed up the removal of the pin, a floating sleeve may be provided on the connector member which by gravity assumes a closed position where the pin is retained inside the connector aperture, and thus a loose fitting slip type pin can be used.

Where core samples are being collected in the presence of subterranean fluids, such as water or hydrocarbons, preferably the connector member is provided with a check valve to allow the fluids to pass upward through the barrel assembly and connector member and into the drill string, to prevent fluid collection and dilution in and around the core sample.

BRIEF DESCRIPTION OF THE DRAWINGS

FIG. 8 shows an exploded view of a core sampler constructed in accordance with the present invention.

FIG. 9A is an elevational view of an alternative embodiment of the tang member of FIG. 4A, having a hexagonally-shaped portion that engages the connector member.

FIG. 9B is a top view of the tang member of FIG. 9A.

DETAILED DESCRIPTION

Figure 1:
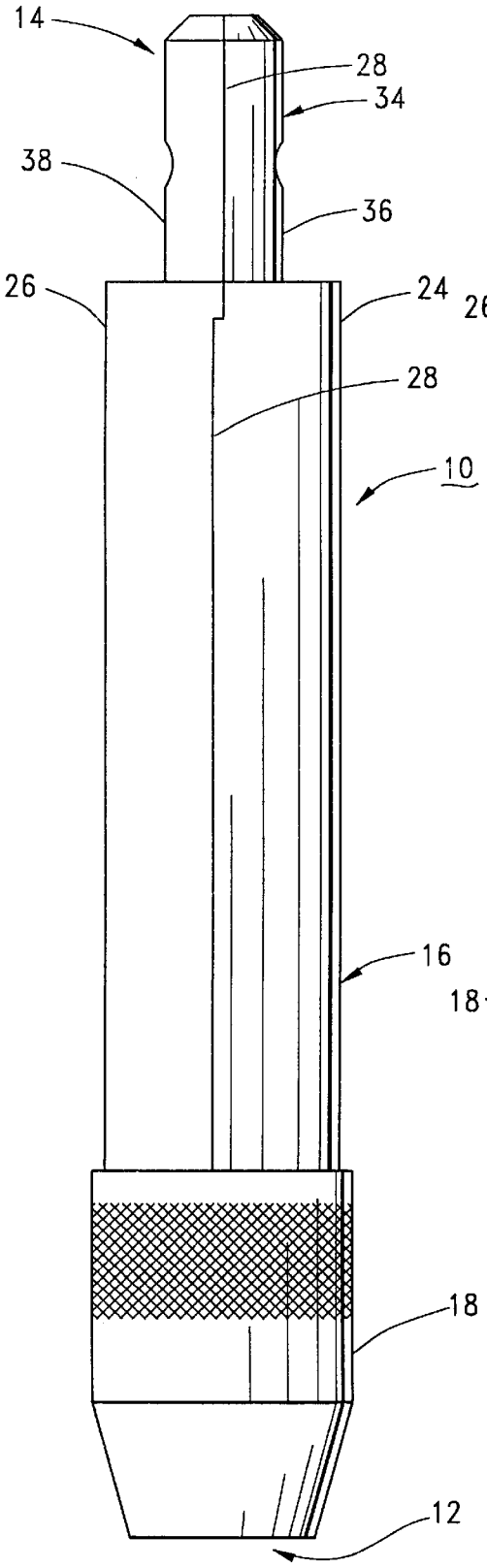
FIG. 1 is an elevational view of a barrel assembly and a shoe of a core sampler constructed in accordance with the present invention.

Referring particularly to FIG. 1, shown therein is a portion of a core sampler 10 constructed in accordance with a preferred embodiment of the present invention. The core sampler 10 also has a connector member which is discussed in detail below. The portion of the core sampler 10 shown in FIG. 1 is that portion which is removed from a drill string of a drilling rig in order to retrieve a collected core sample. From FIG. 1 it will be noted that a lower end 12 provides an opening through which the core sample is collected, and an upper end 14 is attached to the connector member as described below.

Figure 2:
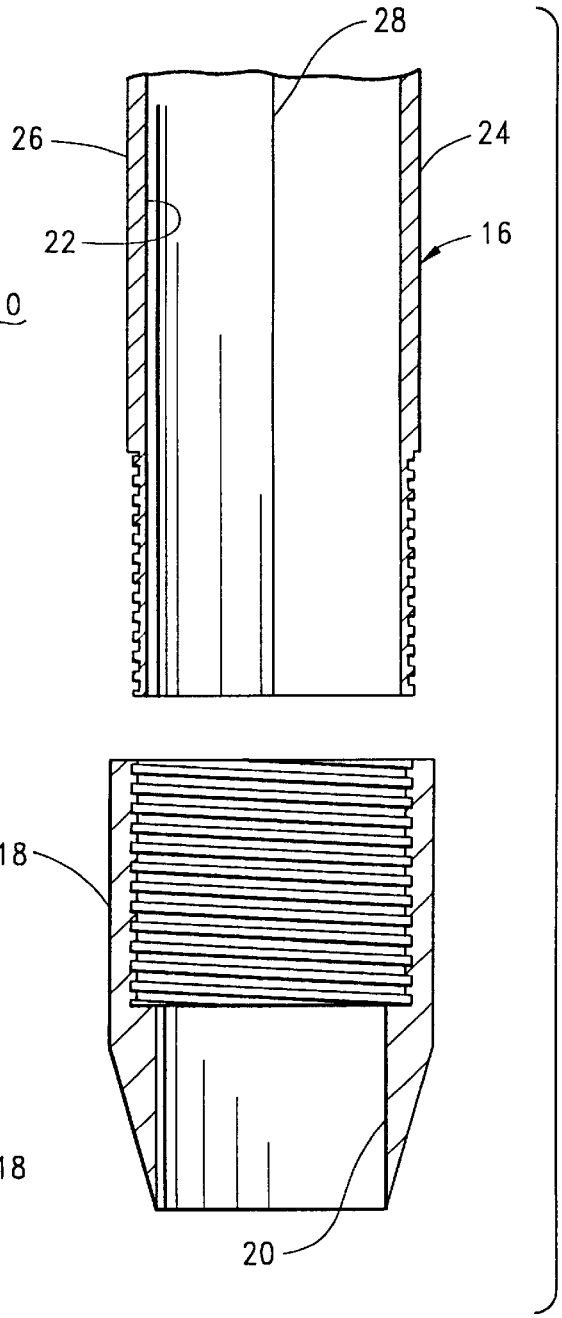
FIG. 2 is a sectional view of a portion of the barrel assembly and the shoe of FIG. 1.

FIG. 1 shows a barrel assembly 16 and a shoe 18, the barrel assembly 16 threadingly engaging the shoe 18, as shown in FIG. 2 which shows a sectional view of the shoe 18 threadingly disengaged from the barrel assembly 16. It will be noted that the shoe 18 has a bore 20 that is matingly aligned with a bore 22 of the barrel assembly 16, the bores 20, 22 forming an internal passageway for receiving disposition of the subterranean core sample.

Figure 3A:
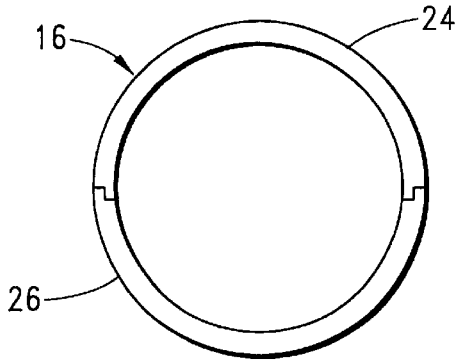
FIG. 3A is an end view of the barrel assembly of FIG. 2, showing the interlocking relationship of the first and second members forming the tubular barrel assembly.
Figure 3B:
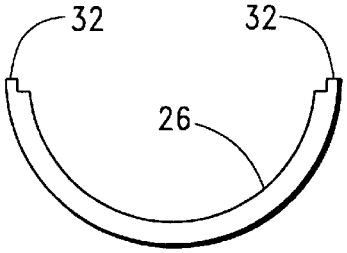
FIG. 3B is an end view of the second member of the barrel assembly of FIG. 2.
Figure 3C:
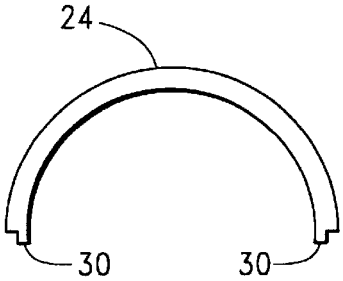
FIG. 3C is an end view of the first member of the barrel assembly of FIG. 2.

To facilitate the removal of the core sample, the barrel assembly 16 is longitudinally split into a first member 24 and a second member 26. FIGS. 3A through 3C illustrate the interlocking relationship of the first member 24 and second member 26 to form a longitudinally separable seam 28. The first member 24 has longitudinal grooves 30 which matingly engage longitudinal tabs 32 of the second member 26 to form the interlocking relationship therebetween.

Returning to FIG. 1, shown therein at an upper end the barrel assembly 16 has a tang 34 for attachment to a connector member as will be discussed further below. It will be noted that the longitudinally separable seam 28 continuously extends along the tang 34, the tang having a first member 36 that is supported by the first member 24 and a second member 38 that is supported by the second member 26. In this manner the barrel assembly 16 is separable into two substantially half-portions after removal of the shoe 18, to facilitate the retrieval of a core sample from the internal passageway.

Figure 4B:
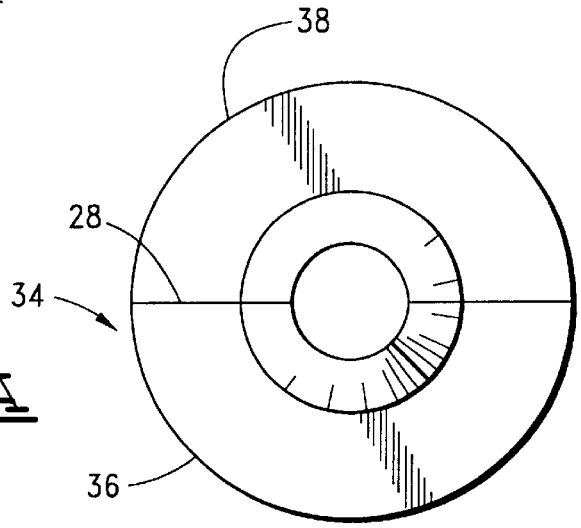
FIG. 4B is a top view of the tang member of FIG. 4A.
Figure 4A:
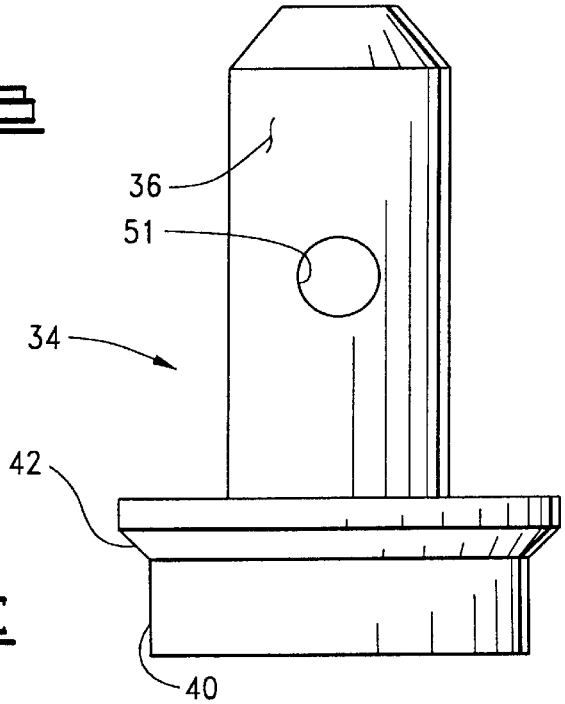
FIG. 4A is an elevational view of the tang member of the barrel assembly of FIG. 1.

FIGS. 4A and 4B show the tang 34 of FIG. 1, which forms a cylindrical member by the joining of the first member 36 and second member 38, and which is separable by the seam 28 therebetween. The first member 36 is rigidly attached, such as by welding, to the first member 24 of the barrel assembly 16. A lip portion 40 of the tang 34 has a radius of curvature so as to slidingly engage the internal bore 22 of the barrel assembly 16, and a tapered shoulder 42 provides a surface for a fillet weld to the first member in a conventional manner. Likewise, the second member 38 is rigidly attached to the second member 26 of the barrel assembly 16.

The barrel assembly 16 is attached to the drill string of a drilling rig apparatus which typically terminates with a threaded shaft for attachment thereto. The core sampler of the present invention has a connector member 44, shown in FIG. 5A, which threadingly attaches to the drill string and which provides for a pinned connection to the tang 34 of the barrel assembly 16. FIG. 5B shows a sectional view of the connector member 44 which has a threaded end 46 for threading engagement with the drill string, and a smooth bore end 48 receiving disposition of the tang 34 of the barrel assembly 16. FIG. 5C shows a laterally disposed aperture 50A which aligns with an aperture 51 of the tang 34 (see FIG. 4A). A locking pin or a conventional nut and bolt (not shown) is disposed in the aligned apertures 50A, 51 to provide a pinned connection between the connector member 44 and the tang 34 of the barrel assembly 16.

In this manner the barrel assembly 16 is removable from the drill string by removing the locking pin or threaded fastener that provides the pinned connection of the tang 34 to the connector member 44. The connector member 44 thus remains threadingly engaged with the drill string, it not being necessary to separate the two in order to retrieve a core sample from the barrel assembly 16.

Figure 5A:
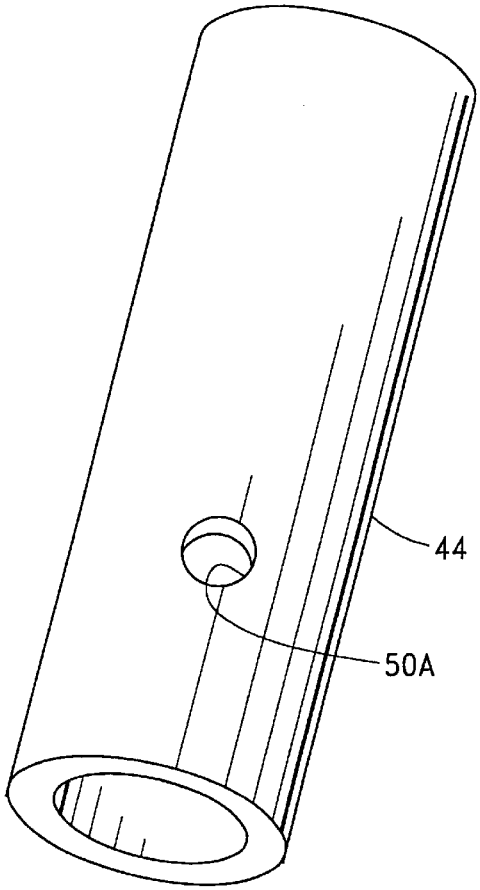
FIG. 5A shows the connector member of a core sampler of the present invention which joins the barrel assembly of FIG. 1 to a drill string.
Figure 5B:
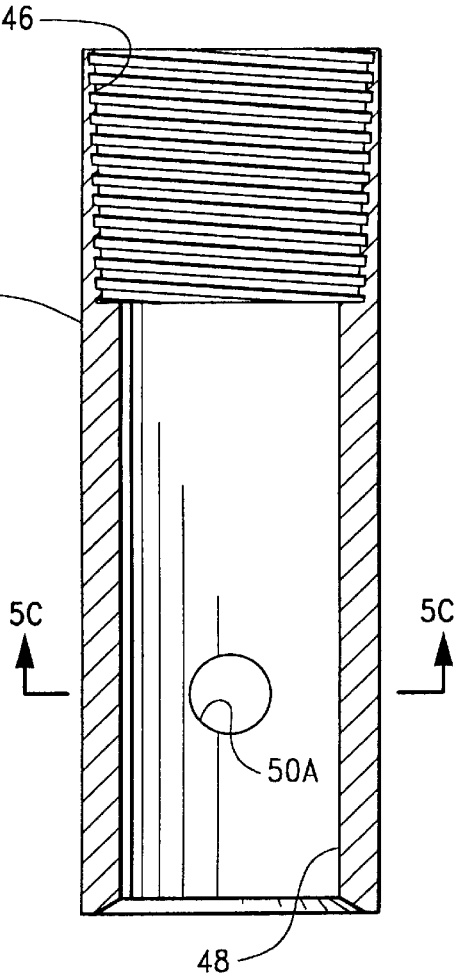
FIG. 5B is a sectional view of the connector member of FIG. 5A.
Figure 5C:
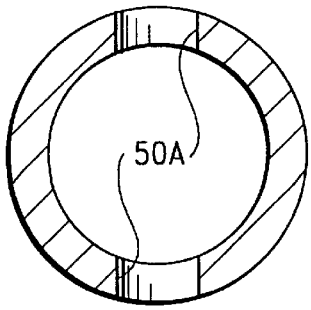
FIG. 5C is a sectional view of the connector member of FIG. 5A taken along the section 5C—5C of FIG. 5B.
Figure 6:
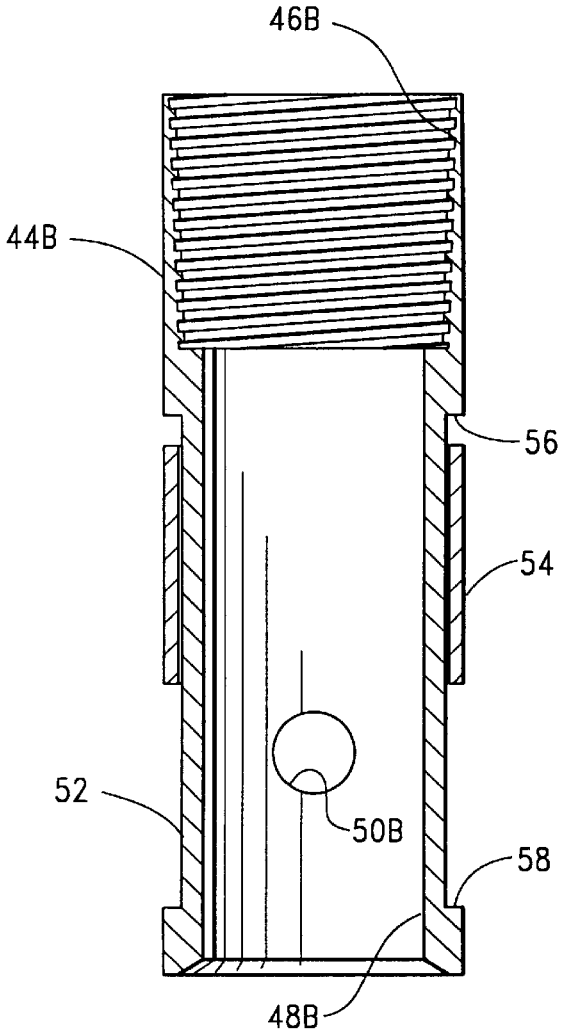
FIG. 6. is a sectional view of an alternative embodiment of the connector member having a sliding cover which operably locks the retaining pin in place.

Turning now to FIG. 6, shown therein is an alternative embodiment of the connector member 44B, which like the connector member 44 of FIGS. 5A through 5C has a threaded end 46B and a smooth bore end 48B, as well as an aperture 50B for a pinning connection with the tang 34 of the barrel assembly 16. The connector member 44B furthermore has a longitudinal channel 52 which slidingly supports a sleeve 54 between an upper shoulder 56 and a lower shoulder 58. In an operable position the connector member 44B is substantially vertically oriented with the threaded end 46B above the smooth bore end 48B. In this orientation the sleeve 54 is urged by gravity downward to pressingly engage the lower shoulder 58, whereat the sleeve 54 covers the aperture 50B. In this manner, a standard non-locking pin can be used, such as a slip-fit drill rod, and the sleeve 54 retains the pin within the aperture 50B. Access to the pin for removal is achieved by raising the sleeve 54 upward.

Figure 7:
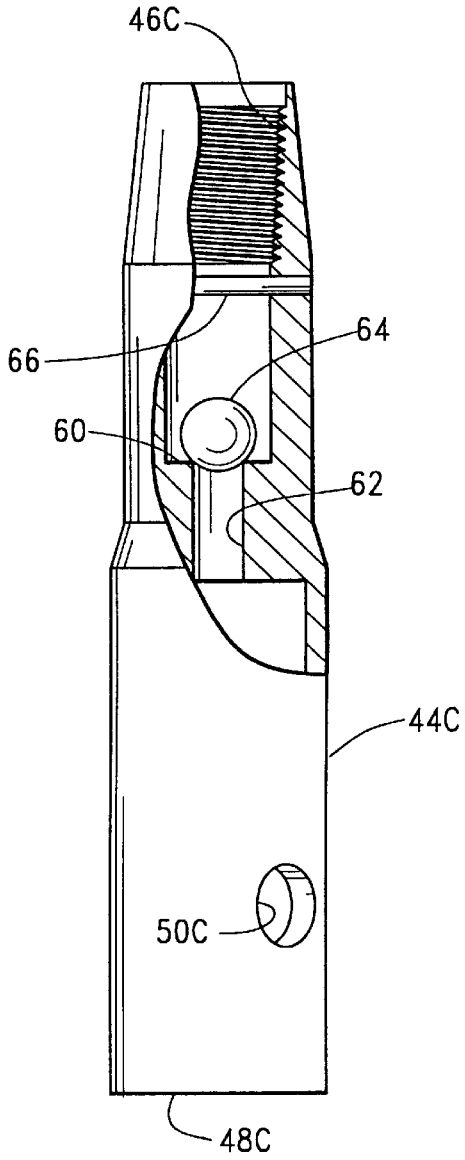
FIG. 7 is a partial sectional view of an alternative embodiment of the connector member having a check valve.
Figure 5:
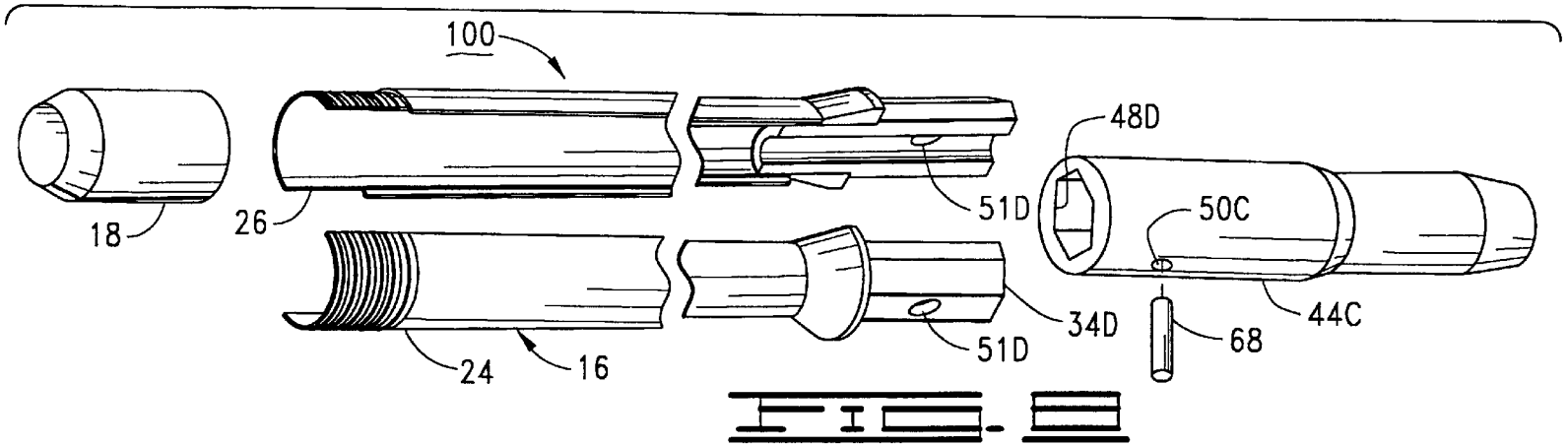
Figure 5B:
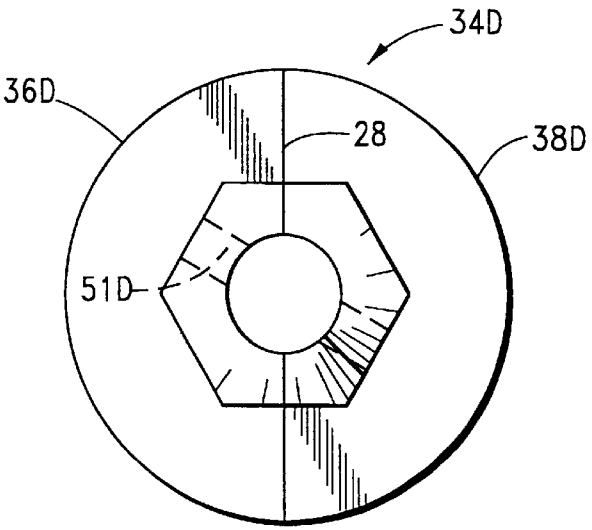
Figure 5A:
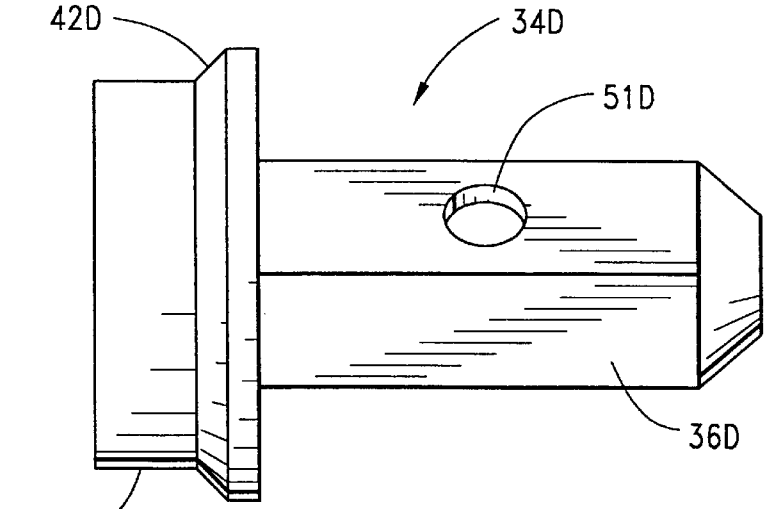

FIG. 7 shows an alternative embodiment of a connector member 44C which has a check valve assembly for use in gathering core samples where subterranean fluids, such as water or hydrocarbons, are present. The connector member 44C has a threaded end 46C which threadingly attaches to the drill string, and a smooth bore 48C for receiving disposition of the tang 34 of the barrel assembly 16. An aperture 50C passes laterally through the connector member 44C to receive a pin (not shown) for a pinning attachment to the tang 34.

From FIG. 7 it will be noted the connector 44C has a valve seat 60 which forms a restrictive aperture 62 which connects the smooth bore end 48C and the threaded end 46C. A valve ball 64 is appropriately sized to matingly engage the aperture 62 and to thereby provide a sealing engagement therewith to prevent a flow of fluid downward through the connector member 44C from the threaded opening end 46C to the smooth bore end 48C. A pin 66 is disposed in the connector member 44C above the ball 64 to limit the upward extent of travel.

In this manner, one skilled in the art will recognize that the ball 64 cooperates with the valve seat 60 and the pin 66 to provide a one-way flow of fluid upward through the connector member 44C. The weight of the ball 64 and of an accumulated fluid head (not shown) above the ball 64 provide a sealing force on the ball 64 against the valve seat 60. Upward fluid force that is greater than the downward sealing force will sealingly disengage the ball 64 and by the pressure differential fluid will flow upwardly through the connector member 44C. The ball 64 is constrained in its upward travel by the pin 66, and the ball sealingly re-engages the valve seat 60 when the fluid pressure below the ball 64 is equal or less than the fluid pressure above the ball 64.

FIG. 8 shows an exploded view of a core sampler 100 constructed in accordance with the present invention. The barrel assembly 16 is shown with the first member 24 and second member 26 separated to provide access to a core sample (not shown) disposed in the internal passageway formed therebetween. In an assembled, operable mode the lower end of the barrel assembly 16 is retained by the shoe 18 which threadingly engages the mating first and second members 24, 26. The upper end of the barrel assembly is retained by the pinned connection of a pin 68 passing through the aperture 50C of the connector member 44C and passing through the aperture 51D of the tang 34. It will be noted that although the pin 68 is illustrated in FIG. 8 as a wedging-type roll pin, that other conventional type pins could be equally employed by those skilled in the art, such as a conventional offset locking type pin or a conventional threaded fastener.

It will be noted that the tang 34D of FIG. 8 is of a hexagonal shape rather than a circular shape as previously described. Such an alternative embodiment of the tang 34D is useful especially in the use of the core sampler 10 in conjunction with a hollow stem auger where the mechanical linkage between the connector member 44C and the tang 34D is enhanced by the surface areas provided by the flats of the hexagonally shaped smooth bore 48D in cooperation with the tang 34D. FIGS. 9A and 9B show the hexagonally shaped tang member 34D of FIG. 8.

It is clear that the present invention is well adapted to carry out the objects and to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed.

What is claimed is:

1. A core sampler apparatus for collecting subterranean core samples with a drilling rig having a drill string, the core sampler comprising:

a barrel assembly having a passageway for receiving deposition of the core sample, the barrel assembly having a tang portion extending from an upper end thereof, and wherein the barrel assembly is split along a longitudinal axis into a first half-portion and a second half-portion, wherein the half portions are matingly engaged by the engagement of a tab of the first portion matingly engaging a groove of the second half portion;

a shoe attached to a lower end of said barrel assembly with an opening contiguous with the passage way of said barrel assembly, the first and second half portions of the barrel assembly having a spiral thread which, when the first and second half portions are matingly engaged, is threadingly engaged by the shoe; and a connector member attached to the upper end of said barrel assembly and attached to the drill string, the connector member having a bore with a characteristically close fitting relationship to the tang portion of the barrel assembly, the connector member having a first aperture, and the tang portion having a second aperture, and wherein a pin has a first portion disposed in said first aperture and simultaneously has a second portion disposed in said second aperture to pinningly engage the tang portion to the connector member, and wherein the connector member has a sliding sleeve moveable between a locked and an unlocked position, where in the locked position the sliding sleeve covers the first aperture of the connector member to retain the pin therein; and wherein the connector member has a channel longitudinally extending from an upper shoulder to a lower shoulder, the channel supporting the sliding sleeve between the locked and unlocked positions.

2. A core sampler apparatus for collecting subterranean core samples with a drilling rig having a drill string, the core sampler comprising:

a barrel assembly having a passageway for receiving deposition of the core sample, the barrel assembly having a tang portion extending from an upper end thereof, and wherein the barrel assembly is split along a longitudinal axis into a first half-portion and a second half-portion, wherein the half portions are matingly engaged by the engagement of a tab of the first portion matingly engaging a groove of the second half portion;

a shoe attached to a lower end of said barrel assembly with an opening contiguous with the passage way of said barrel assembly, the first and second half portions of the barrel assembly having a spiral thread which, when first and second half portions are matingly engaged, is threadingly engaged by the shoe; and a connector member attached to the upper end of said barrel assembly and attached to the drill string, the connector member having a bore with a characteristically close fitting relationship to the tang portion of the barrel assembly, the connector member having a first aperture, and the tang portion having a second aperture, and wherein a pin has a first portion disposed in said first aperture and simultaneously has a second portion disposed in said second aperture to pinningly engage the tang portion to the connector member, and wherein the connector member has a sliding sleeve moveable between a locked and an unlocked position, where in the locked position the sliding sleeve covers the first aperture of the connector member to retain the pin therein; and wherein the connector member has a third aperture, wherein the pin further simultaneously has a third portion disposed in said third aperture, and wherein the sliding sleeve further covers the third aperture of the connector member to retain the pin therein.

3. A connector assembly for interconnecting a subterranean core sampler with a drill string, the core sampler having an upwardly extending tang portion with a tang aperture, the connector assembly comprising:

an elongated body having an upper end attachable to the drill string, a lower end having a bore sized to mate with the tang portion, and a first body aperture;

a pin having a first portion disposable in the tang aperture and simultaneously having a second portion disposable in the first body aperture to pinningly engage the tang portion to the body; and a sliding sleeve, moveable between a locked and an unlocked position, where in the locked position the sliding sleeve covers the first body aperture of the connector member to retain the pin therein; and wherein the body further has a channel longitudinally extending from an upper shoulder to a lower shoulder, the channel supporting the sliding sleeve between the locked and unlocked positions.

4. A connector assembly for interconnecting a subterranean core sampler with a drill string, the core sampler having an upwardly extending tang portion with a tang aperture, the connector assembly comprising:

an elongated body having an upper end attachable to the drill string, a lower end having a bore sized to mate with the tang portion, and a first body aperture;

a pin having a first portion disposable in the tang aperture and simultaneously having a second portion disposable in the first body aperture to pinningly engage the tang portion to the body; and a sliding sleeve, moveable between a locked and an unlocked position, where in the locked position the sliding sleeve covers the first body aperture of the connector member to retain the pin therein; and wherein the body has a second body aperture, wherein the pin further simultaneously has a third portion disposed in said second body aperture, and wherein the sliding sleeve further covers the second body aperture of the connector member to retain the pin therein.

* * * * *

UNITED STATES PATENT AND TRADEMARK OFFICE

CERTIFICATE OF CORRECTION

PATENT NO. : 6,095,259
DATED : August 1, 2000
INVENTOR(S) : Robert C. Keyes

It is certified that error appears in the above-identified patent and that said Letters Patent is hereby corrected as shown below:

Column 5,
Line 34, replace "tang 34." with -- tang 34D. --.
Line 43, replace "core sampler 10" with -- core sampler 100 --.

Signed and Sealed this

First Day of July, 2003

JAMES E. ROGAN
*Director of the United States Patent and Trademark Office*